US008881319B2

(12) United States Patent
Schuster et al.

(10) Patent No.: US 8,881,319 B2
(45) Date of Patent: Nov. 11, 2014

(54) EXTERNAL FLOAT EXTENSION

(75) Inventors: Michael J. Schuster, Joliet, IL (US); Duston E. A. Stutzman, Plainfield, IL (US); Douglas C. Saunders, Plainfield, IL (US)

(73) Assignee: Danco, Inc., Irving, TX (US)

( * ) Notice: Subject to any disclaimer, the term of this patent is extended or adjusted under 35 U.S.C. 154(b) by 476 days.

(21) Appl. No.: 13/051,742

(22) Filed: Mar. 18, 2011

(65) Prior Publication Data

US 2011/0225715 A1 Sep. 22, 2011

Related U.S. Application Data

(60) Provisional application No. 61/315,494, filed on Mar. 19, 2010.

(51) Int. Cl.

| | |
|---|---|
| ***E03D 1/14*** | (2006.01) |
| ***E03D 1/00*** | (2006.01) |
| ***E03D 1/24*** | (2006.01) |
| ***E03D 3/10*** | (2006.01) |
| ***E03D 1/34*** | (2006.01) |
| ***E03D 1/30*** | (2006.01) |

(52) U.S. Cl.

CPC ..... *E03D 1/304* (2013.01)
USPC ..... 4/324; 4/415; 4/331; 4/355; 4/356; 4/391

(58) Field of Classification Search

CPC ..... E03D 1/14; E03D 1/00; E03D 1/24; E03D 3/10; E03D 1/34
USPC ..... 4/324, 325, 327, 331, 345, 437, 355, 4/356, 391, 394, 395–404, 415; 137/426
See application file for complete search history.

(56) References Cited

U.S. PATENT DOCUMENTS 4,969,218 A * 11/1990 Comparetti ..... 4/325
7,827,627 B2 * 11/2010 Dayton et al. ..... 4/325

* cited by examiner

*Primary Examiner* — Huyen Le
*Assistant Examiner* — Christine Skubinna
(74) *Attorney, Agent, or Firm* — Thomas | Horstemeyer, LLP.

(57) ABSTRACT

Various methods and systems are provided for external float extensions. In one embodiment, an external float extension includes an external adjustment rod configured to affix to a quick flush float of a dual flush assembly and an external float configured to be positioned on the external adjustment rod. In another embodiment, a dual flush assembly includes a quick flush float, an external adjustment rod affixed to the quick flush float, and an external float positioned on the external adjustment rod.

20 Claims, 9 Drawing Sheets

EXTERNAL FLOAT EXTENSION

CROSS REFERENCE TO RELATED APPLICATIONS

This application claims priority to U.S. provisional application entitled "EXTERNAL FLOAT EXTENSION" having Ser. No. 61/315,494, filed Mar. 19, 2010, wherein the entirety of the provisional application is hereby incorporated by reference.

BACKGROUND

Most dual flush toilet systems are provided as a package including a dual flush assembly installed in the tank and an activation device to initiate operation of the dual flush assembly in one of the dual flush modes: quick flush for liquids and full flush for solids. In some instances, the water provided during a quick flush is insufficient to properly evacuate and refill the toilet bowl.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
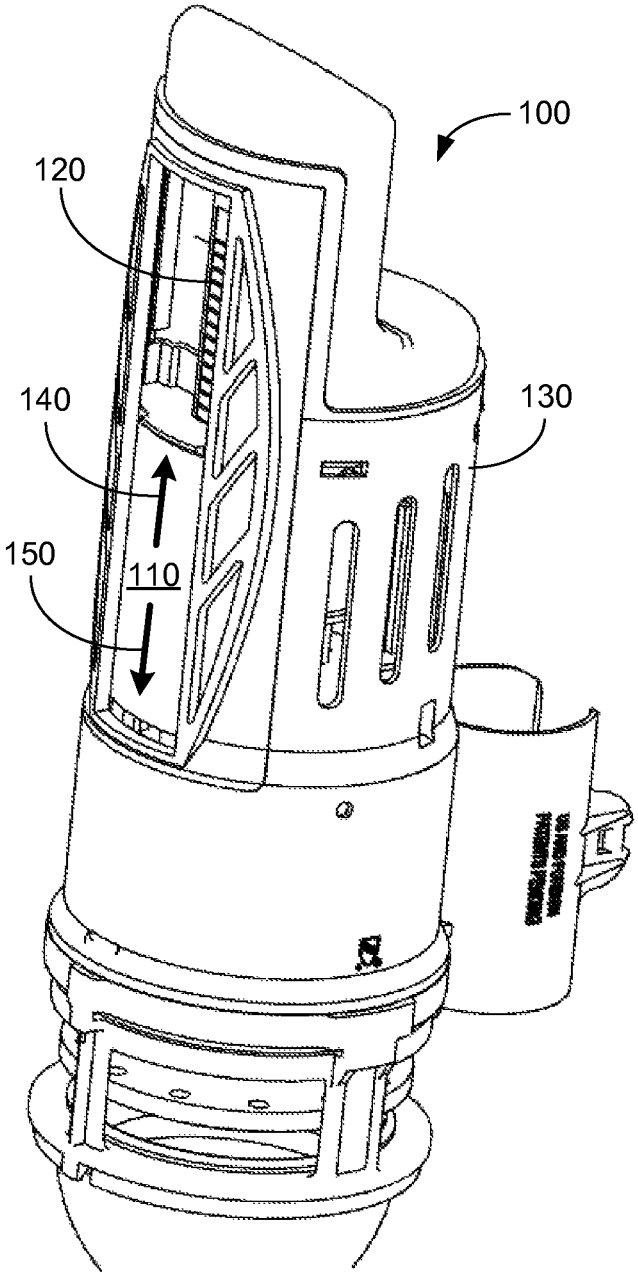
FIG. 1 (Prior Art)
FIG. 1 is a drawing of a dual flush assembly.

With reference to FIG. 1, shown is a dual flush assembly 100 of a dual flush toilet system. When activated, the dual flush assembly 100 in one of the dual flush modes: quick flush for liquids and full flush for solids. The dual flush assembly 100 includes a quick flush float 110 affixed to an adjustment rod 120 within the assembly housing 130. The quick flush float 110 can be discretely positioned on the adjustment rod 120. The position of the quick flush float 110 on the adjustment rod 120 controls the amount of water used during a quick flush of the toilet. Upward adjustment (arrow 140) of the position of the quick flush float 110 on the adjustment rod 120 decreases the amount of water being supplied to the toilet bowl, while downward adjustment (arrow 150) of the position of the quick flush float 110 on the adjustment rod 120 increases the amount of water being supplied to the toilet bowl. However, downward adjustment of the quick flush float 110 is restricted by the internal arrangement of the dual flush assembly 100, thus limiting the amount of water that can be supplied to the toilet bowl during a quick flush of the toilet.

Figure 2:
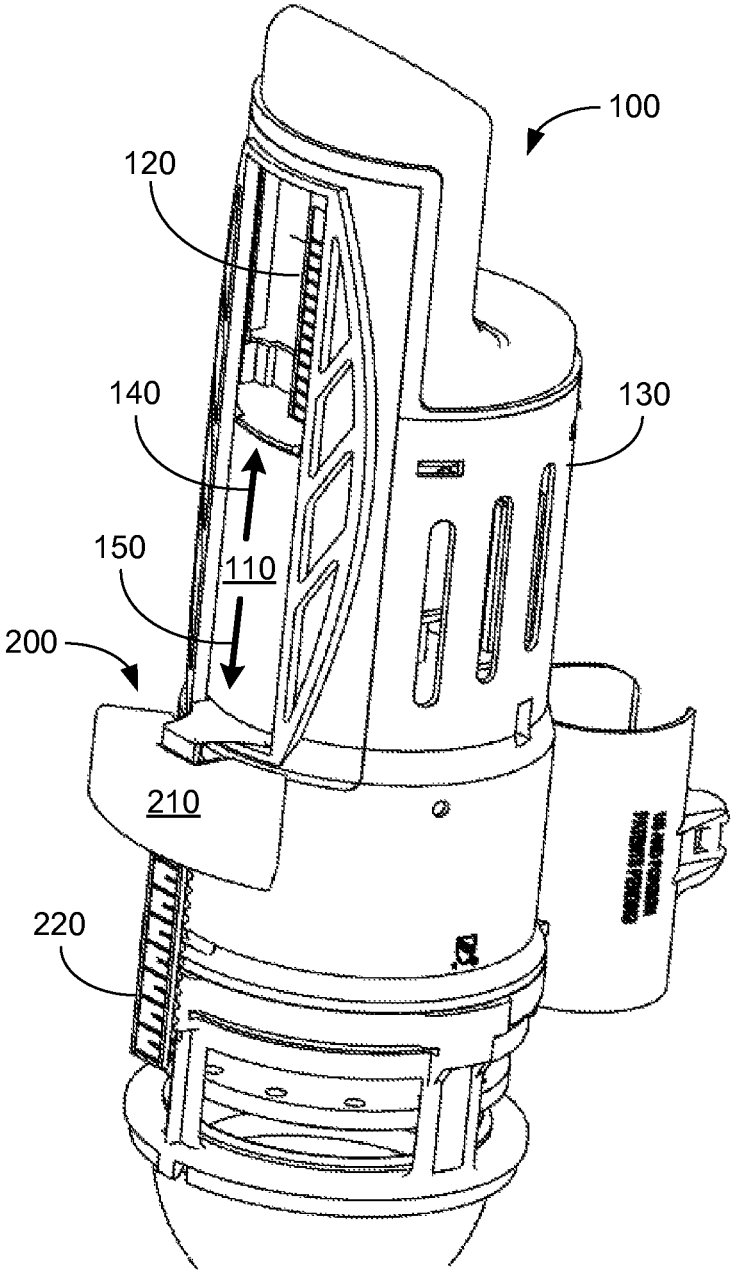
FIG. 2 is a drawing of the dual flush assembly of FIG. 1 including an external float extension according to various embodiments of the disclosure.

Referring next to FIG. 2, shown is the dual flush assembly 100 including an external float extension 200 detachably connected to the quick flush float 110 according to various embodiments of the disclosure. When installed, the external float extension 200 supersedes the function of the quick flush float 110, thereby allowing for further adjustment of the amount of water that can be supplied to the toilet bowl during a quick flush. The external float extension 200 includes an external float 210 affixed to an external extension rod 220.

Figure 3A:
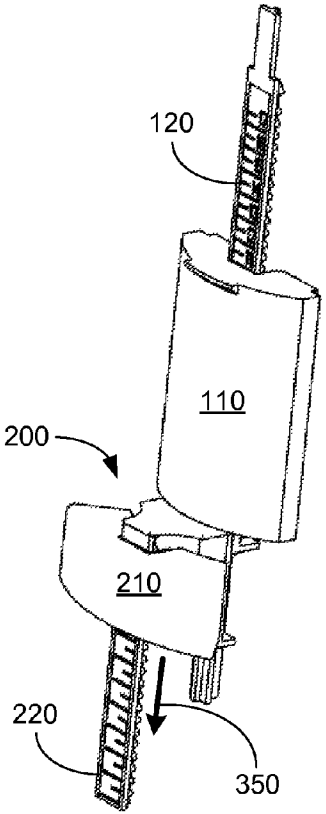
FIGS. 3A-C are drawings that provide various views of the external float extension of FIG. 2 according to various embodiments of the disclosure.
Figure 3B:
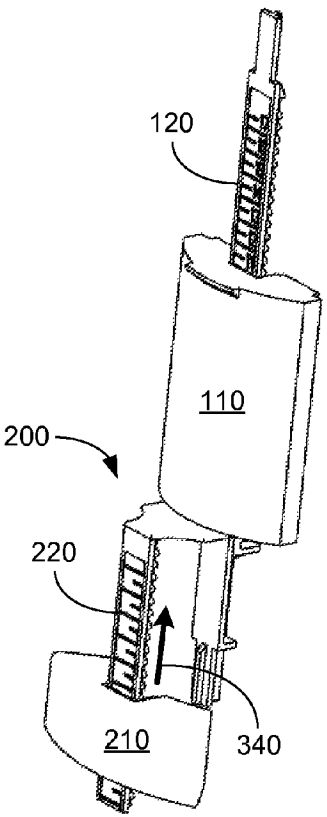
Figure 3C:
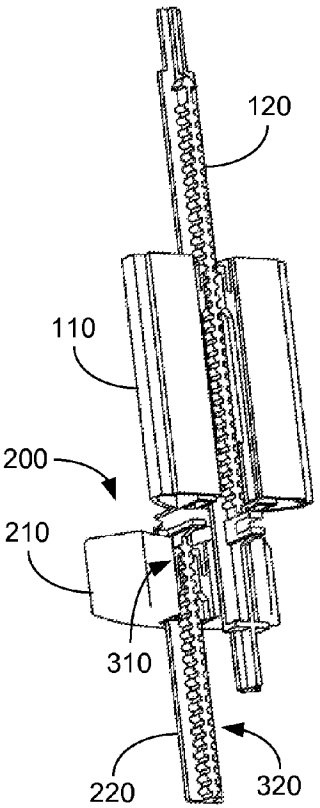

With reference to FIGS. 3A-C, shown is the external float extension 200 detachably connected to the quick flush float 110 in accordance with one embodiment of the disclosure. In the embodiment of FIGS. 3A-C, the external float 210 can be discretely positioned on the external adjustment rod 220. Downward adjustment (arrow 350) of the position of the external float 210 on the external adjustment rod 220 further increases the amount of water being supplied to the toilet bowl. The amount of water may be reduced by upward adjustment (arrow 340) of the position of the external float 210 on the external adjustment rod 220.

FIG. 3C illustrates the reverse side of the external float extension 200. In the embodiment of FIGS. 3A-C, external adjustment rod 220 includes a series of pairs of notches 320 located opposite each other to allow for discrete positioning of the external float 210 on the external adjustment rod 220. The external float 210 includes a spring-tab assembly 310 that engages with the notches 320 of the external adjustment rod to fix the external float 210 in position. In the embodiment of FIGS. 3A-C, the spring-tab assembly 310 is configured to engage a pair of notches 320. Alternatively, the external adjustment rod 220 may include a row of notches along one side of the external adjustment rod with a corresponding spring-tab assembly configured to engage only one notch at a time. Other appropriate means for fixing the position of the external float 210 on the external adjustment rod 220 may also be utilized such as, but not limited to, a snap or clip connection. For example, openings or recesses may be distributed along the length of the external adjustment rod 220 into which the external float may be snapped or clipped in position. In other embodiments, the external float 210 may be continuously positioned on the external adjustment rod 220 using, for example, a friction fit interference or set screw to hold the external float 210 in position.

Figure 4A:
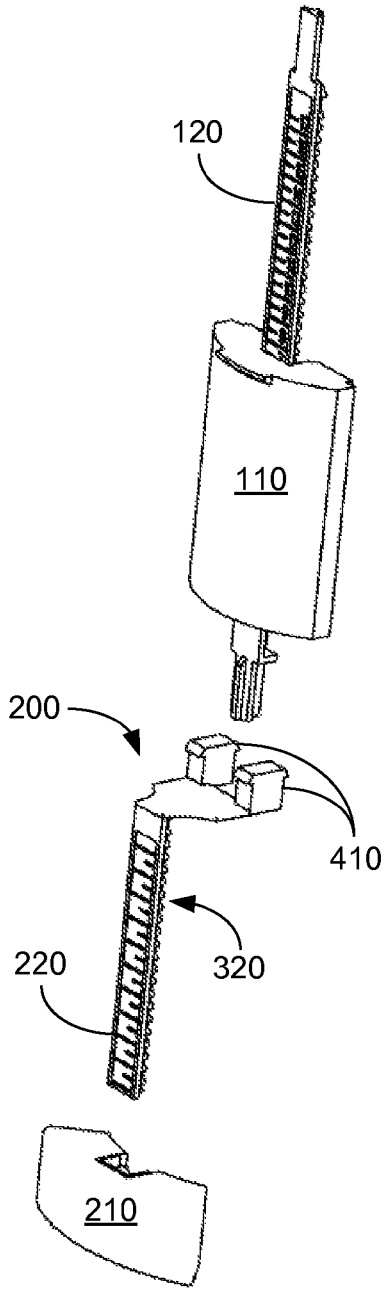
FIGS. 4A-C are drawings that provide various exploded views of the external float extension of FIG. 2 according to various embodiments of the disclosure.
Figure 4B:
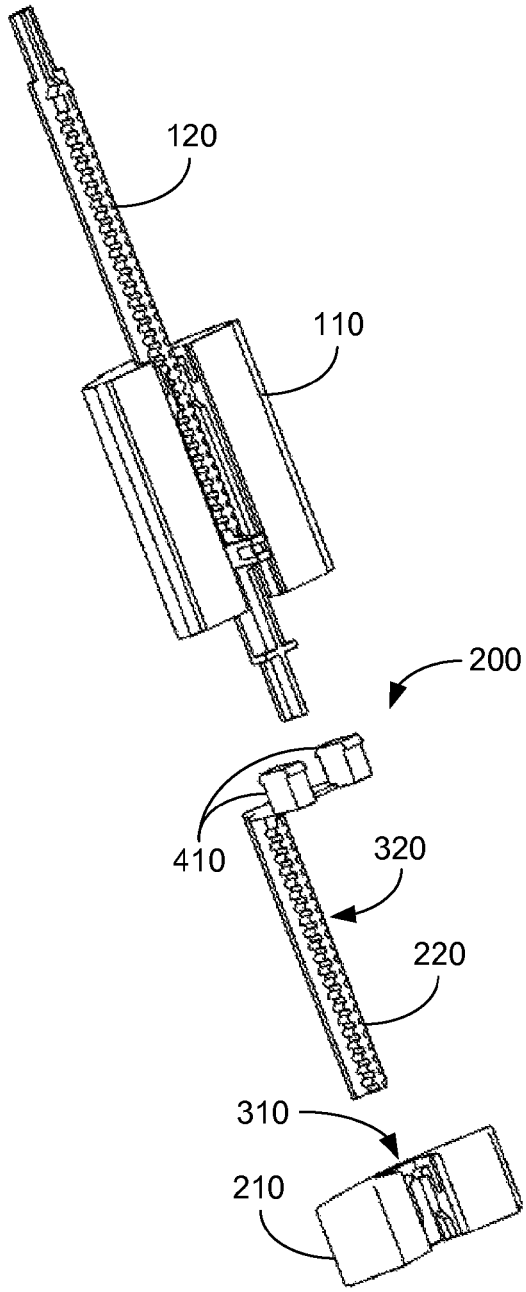
Figure 4C:
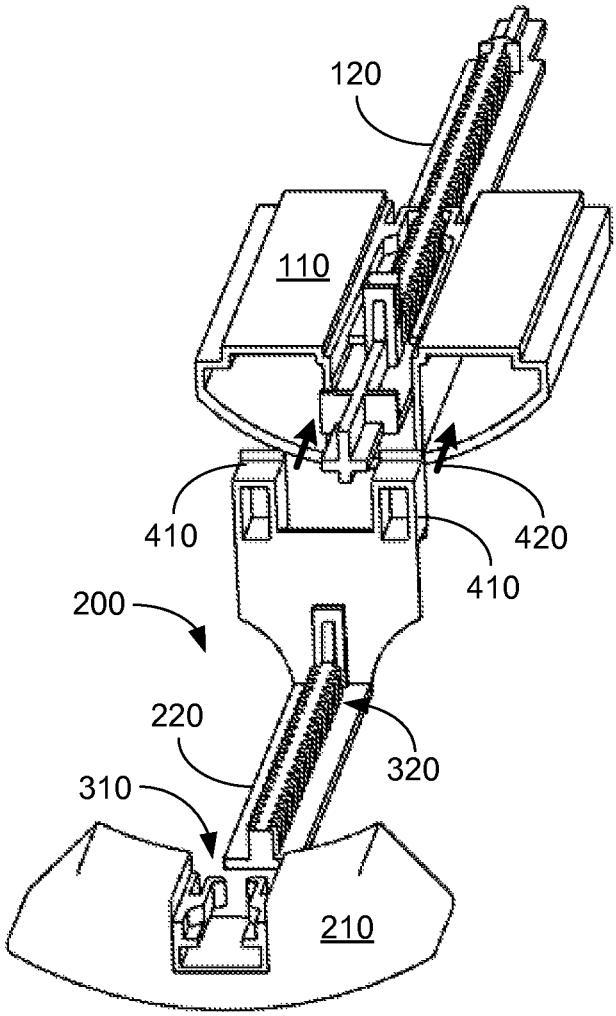

Referring to FIGS. 4A-C, shown are exploded views of the external float extension 200. The external float extension 200 is detachably connected to the quick flush float 110. In the embodiment of FIGS. 4A-C, the external float extension 200 is connected to the bottom of the quick flush float 110 by tabs 410 affixed at the top of the external adjustment rod 220. As illustrated in FIG. 2, the top of the external adjustment rod 220 is configured to extend into the assembly housing 130 of the dual flush assembly 100 to allow for insertion of tabs 410 into the bottom of the quick flush float 110 while the external float 210 remains external to the assembly housing 130. Referring back to the exemplary embodiment of FIG. 4C, the bottom of the quick flush float 110 is open. Tabs 410 are inserted (arrows 420) into the open bottom of the quick flush float 110 (as illustrated in FIG. 3C) and are held in place by an interference fit with the walls of the quick flush float 110. Alternatively, other appropriate means for affixing the external float extension 200 to the quick flush float 110 may be utilized. For example, the external float extension 100 may be attached to the quick flush float 110 by screws, snaps, clips, or other fastener. Moreover, in other embodiments, the external float extension 200 may be affixed to the other exposed portions of the quick flush float 110 such as, but not limited to, the top or front of the float 110. In some embodiments, the external float extension 200 may be permanently affixed to the quick flush float 110.

Figure 5:
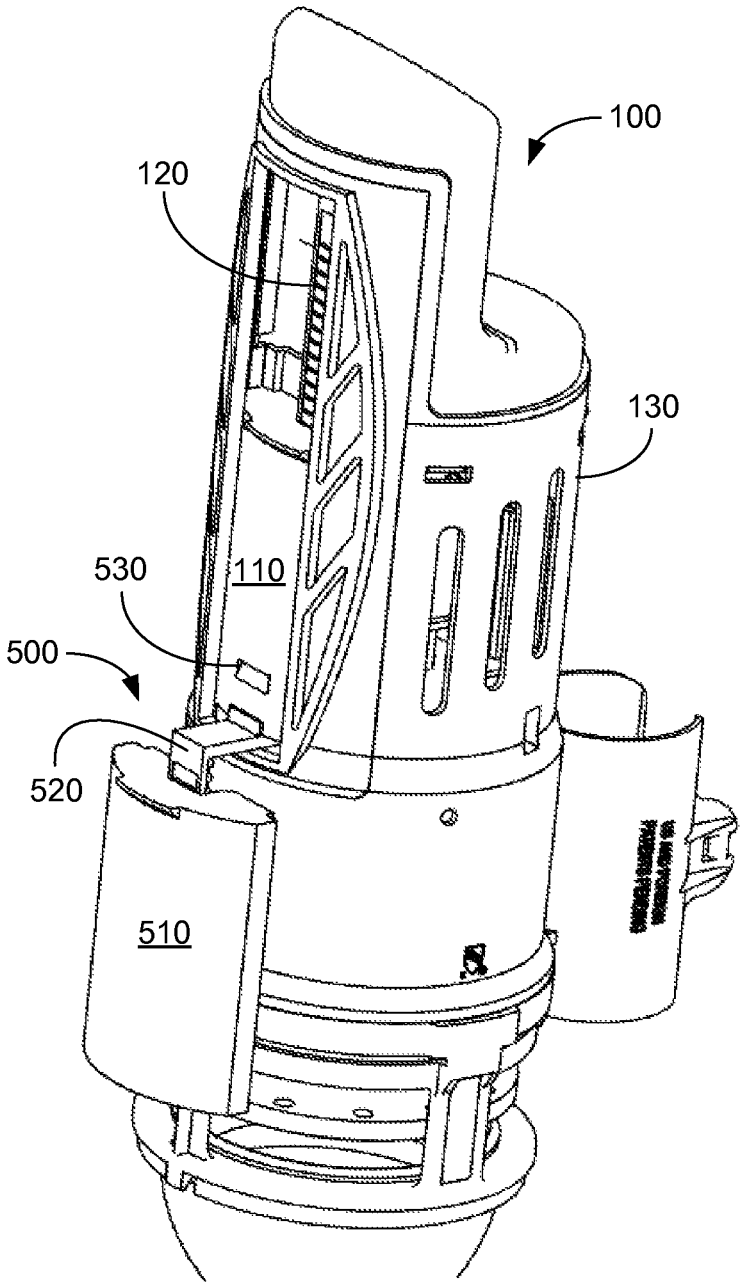
FIG. 5 is a drawing of the dual flush assembly of FIG. 1 including an external float extension according to other embodiments of the disclosure.

Referring next to FIG. 5, shown is the dual flush assembly 100 including another embodiment of an external float extension 500 detachably connected to the quick flush float 110 according to various embodiments of the disclosure. The exemplary external float extension 500 of FIG. 5 includes an external float 510 affixed to an external extension rod 520. It should be noted that the exemplary external floats 210 of FIGS. 2 and 510 of FIG. 5 may be utilized in either external float extension 200 or 500. As described with respect to FIGS. 3A-C, similar to external float 210, external float 510 can be discretely positioned on the external adjustment rod 520.

Figure 6:
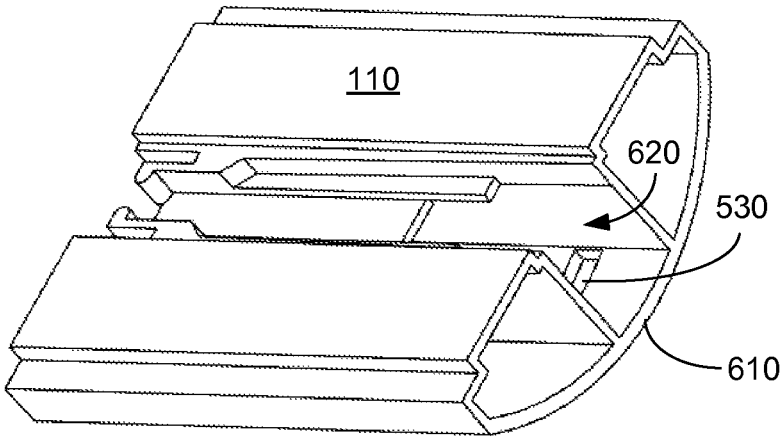
FIG. 6 is drawings that provide a rear view of the quick flush float of FIG. 5 according to various embodiments of the disclosure.

In the embodiment of FIG. 5, an opening 530 is included in the quick flush float 110 for attachment of the external float extension 500. With reference to FIG. 6, shown is a rear view of the quick flush float 110 of FIG. 5. Opening 530 extends through the front surface (or wall) 610 of the quick flush float 110 into a center channel 620 that surrounds the adjustment rod 120 when affixed as illustrated in FIGS. 3C and 4B.

Figure 7A:
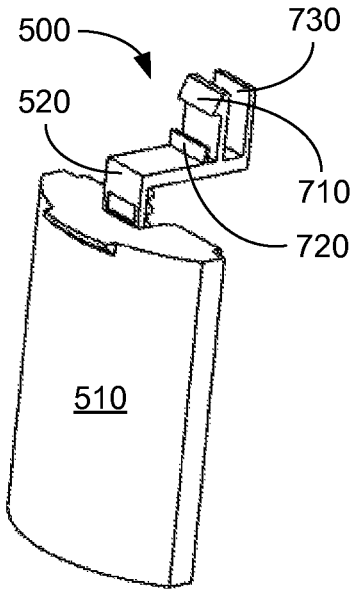
FIGS. 7A-B are drawings that provide various views of the external float extension of FIG. 5 according to various embodiments of the disclosure.
Figure 7B:
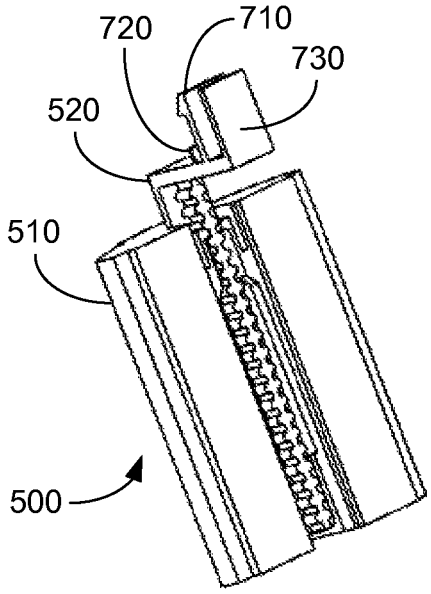

Referring to FIGS. 7A-B, shown are views of the exemplary external float extension 500 of FIG. 5. In the embodiment of FIGS. 5-6, the external float extension 200 is detachably connected to the bottom of the quick flush float 110 by tabs 710 and 720 affixed at the top of the external adjustment rod 520. A separation surface 730 may also be affixed to external adjustment rod 520 to separate adjustment rod 120 from tab 710 (see FIG. 8A) and prevent detachment of the external float extension 500 from the quick flush float 110 during positioning of the quick flush float 110 on the adjustment rod 120.

Figure 8A:
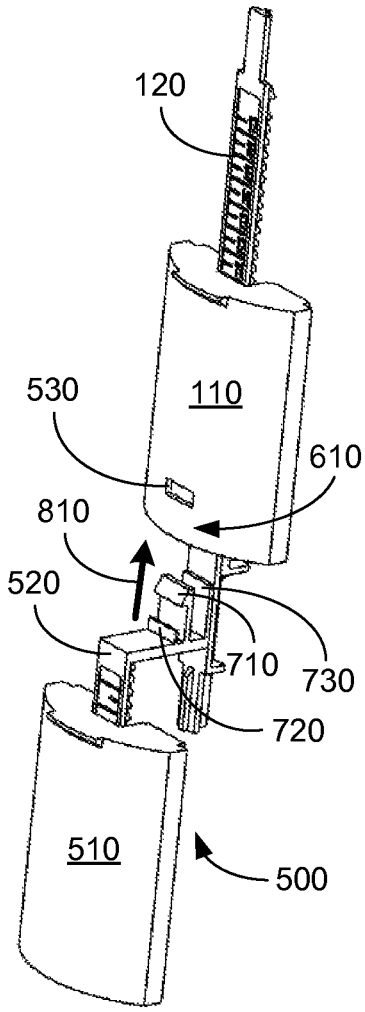
FIGS. 8A-B are drawings that provide various views of the external float extension of FIGS. 7A-B illustrating the detachable connection with quick flush float of FIG. 6 according to various embodiments of the disclosure.
Figure 8B:
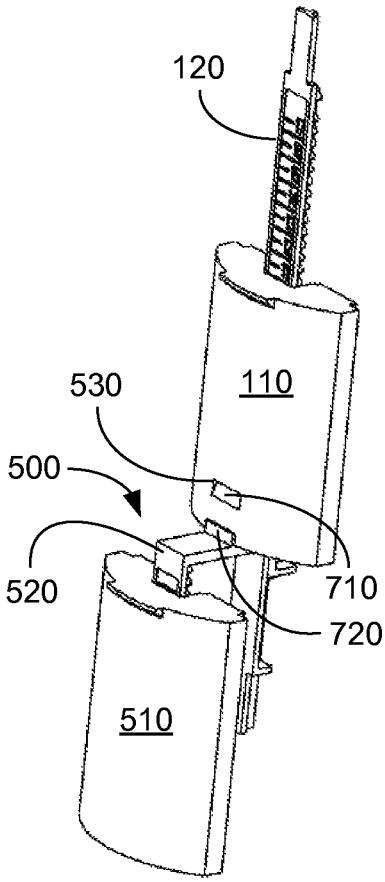

Referring to FIGS. 8A-B, shown are views of the external float extension 500 illustrating the connection with quick flush float 110. Tab 710 is inserted (arrow 810 of FIG. 8A) into the bottom of channel 620 of the quick flush float 110. An extension on the end of tab 710 engages with opening 530 (see FIG. 8B) to detachably connect the external float extension 500 to quick flush float 110. In the embodiments of FIGS. 7A-B and 8A-B, the extension is tapered to aid in insertion of tab 710 into channel 620. Tab 720 engages with the front surface 610 of quick flush float 110 to maintain alignment of the external float extension 500 with quick flush float 110.

Figure 9:
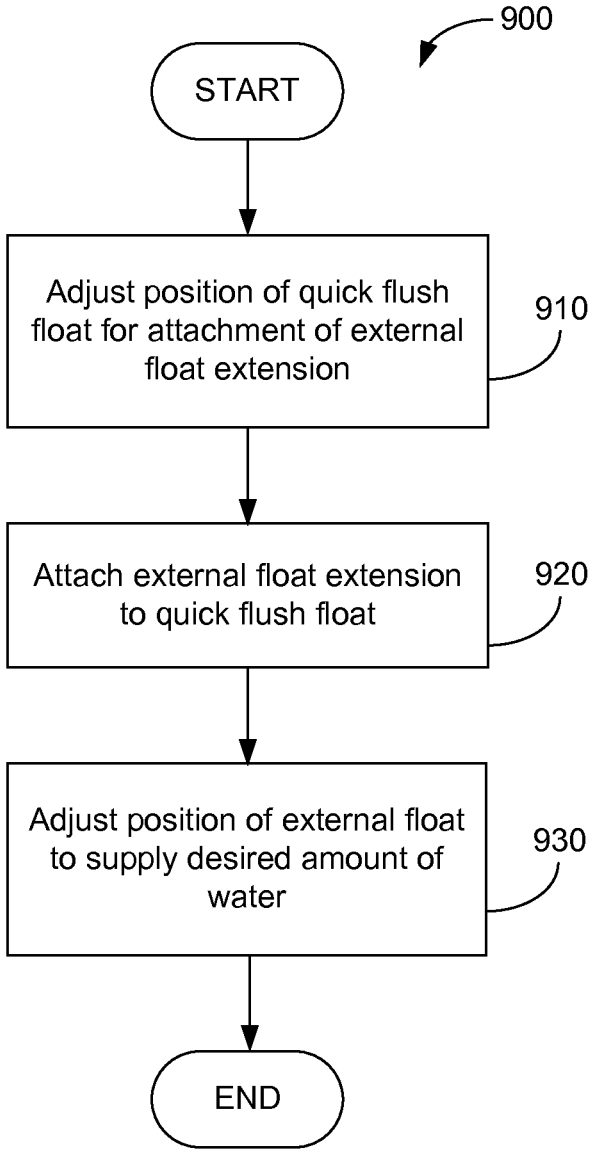
FIG. 9 is a flow chart illustrating the installation of the external float extension of FIG. 2 according to various embodiments of the disclosure.

With reference to FIG. 9, shown is a flow chart 900 illustrating the installation of an external float extension 200 or 500 on an existing dual flush assembly 100, such as that illustrated in FIG. 1. To install the external float extension 200 or 500 on the existing dual flush assembly 100, the quick flush float 110 is positioned to allow for attachment of the external float extension 200 or 500 in block 910. In the embodiment of FIGS. 3A-C and 4A-C, the quick flush float 110 is adjusted upward (arrow 140) to expose the bottom of the float 110. The external float extension 200 or 500 is then attached to the quick flush float 110 in block 920. For example, tabs 410 may be inserted into the bottom of the quick flush float 110 (as illustrated by arrows 420 of FIG. 4C) until fully engaged as illustrated in FIG. 3C. Alternatively, tab 710 may be inserted into channel 620 of the quick flush float 110 (as illustrated in FIG. 8A) until the extension of tab 710 is engaged with opening 530 as illustrated in FIG. 8B. The position of the external float 210 or 510 may then be adjusted in block 930 to supply the desired amount of water to the toilet bowl during a quick flush of the toilet. It should be noted that adjusting the position of the quick flush float 110 will also change the position of the external float 210 or 510.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An external float extension, comprising:

an external adjustment rod configured to fixedly secure to a quick flush float of a dual flush assembly, the quick flush float positioned on an adjustment rod extending along a longitudinal axis of the quick flush float, the quick flush float and the adjustment rod within an assembly housing of the dual flush assembly, where at least a portion of the external adjustment rod is outside the assembly housing of the dual flush assembly; and an external float configured to be repositioned along a length of the portion of the external adjustment rod with the external adjustment rod fixedly secured to the quick flush float.

2. The external float extension of claim 1, wherein the external adjustment rod is further configured to be detached from the quick flush float after being fixedly secured to the quick flush float.

3. The external float extension of claim 1, wherein the external adjustment rod includes at least one tab configured to fixedly secure the external adjustment rod to the quick flush float.

4. The external float extension of claim 3, wherein the at least one tab is configured to fixedly secure the external adjustment rod to a bottom of the quick flush float.

5. The external float extension of claim 4, wherein the at least one tab engages with an inner surface of a side wall of the quick flush float, the side wall extending between the bottom and a top of the quick flush float.

6. The external float extension of claim 5, wherein the side wall includes an opening for engagement with the at least one tab.

7. The external float extension of claim 1, wherein the external float is external to the assembly housing of the dual flush assembly.

8. The external float extension of claim 1, wherein the external float is configured to be discretely repositioned along the length of the external adjustment rod with the external adjustment rod fixedly secured to the quick flush float.

9. The external float extension of claim 8, wherein the external adjustment rod includes a series of notches along the length of the external adjustment rod; and the external float includes a spring-tab assembly configured to engage with at least one of the series of notches to position the external float on the external adjustment rod.

10. A dual flush assembly, comprising:

a quick flush float positioned on an adjustment rod within an assembly housing of the dual flush assembly;

an external adjustment rod fixedly secured to the quick flush float, where at least a portion of the external adjustment rod is outside the assembly housing of the dual flush assembly, where the external adjustment rod is substantially parallel with the adjustment rod; and an external float positioned on the portion of the external adjustment rod outside the assembly housing of the dual flush assembly.

11. The dual flush assembly of claim 10, wherein the external adjustment rod is fixedly secured to a bottom of the quick flush float.

12. The external float extension of claim 4, wherein the external adjustment rod engages with an inner surface of a side wall of the quick flush float to fixedly secure the external adjustment rod.

13. A method, comprising the steps of:

fixedly securing an external float extension to a quick flush float within an assembly housing of a dual flush assembly, the external float extension including an external adjustment rod and an external float, where the external float and at least a portion of the external adjustment rod are outside the assembly housing of the dual flush assembly; and adjusting a position of the external float along a length of the portion of the external adjustment rod with the external adjustment rod physically attached to the quick flush float.

14. The method of claim 13, further comprising the step of:

adjusting a position of the quick flush float within the dual flush assembly before attachment of the external float extension.

15. The method of claim 13, wherein the external float extension is fixedly secured to a bottom of the quick flush float.

16. The external float extension of claim 1, wherein the external float extension is fixedly secured to the quick flush float within the dual flush assembly and extends below the quick flush float outside the dual flush assembly.

17. The external float extension of claim 16, wherein the external float extension is substantially parallel with the adjustment rod.

18. The external float extension of claim 5, wherein the external adjustment rod is fixedly secured to the quick flush float by an interference fit between the at least one tab and inner surfaces of the quick flush float.

19. The dual flush assembly of claim 10, wherein the external float can be repositioned on the portion of the external adjustment rod with the external adjustment rod fixedly secured to the quick flush float.

20. The dual flush assembly of claim 10, wherein the quick flush float can be repositioned along a length of the adjustment rod.

* * * * *